United States Patent [19]

Wilkinson

[11] 4,438,810

[45] Mar. 27, 1984

[54] APPARATUS FOR DECENTRALIZING AND ORIENTING A WELL LOGGING OR PERFORATING INSTRUMENT

[75] Inventor: Gregory J. Wilkinson, Houston, Tex.

[73] Assignee: Dresser Industries, Inc., Dallas, Tex.

[21] Appl. No.: 314,821

[22] Filed: Oct. 26, 1981

[51] Int. Cl.[3] ..... E21B 43/119

[52] U.S. Cl. ..... 166/65 M; 166/55.1; 175/4.51; 175/45

[58] Field of Search ..... 166/65 M, 65 R, 117.5, 166/117.6, 250, 341, 55.1, 241, 243; 175/4.51, 4.5, 45, 79, 80, 82; 285/90, 89

[56] References Cited

U.S. PATENT DOCUMENTS

| | | | |
|---|---|---|---|
| 904,673 | 11/1908 | Bideker | 285/89 |
| 2,692,754 | 10/1954 | Butterworth | 175/82 |
| 3,165,153 | 1/1965 | Lanmon | 166/65 R |
| 3,182,724 | 5/1965 | Shore | 166/65 M |
| 3,396,799 | 8/1968 | Anderson et al. | 166/243 |
| 3,730,282 | 5/1973 | Chapman | 175/4.51 |
| 3,842,918 | 10/1974 | Wolk | 175/4 |
| 4,153,118 | 5/1979 | Hart | 175/4.51 |
| 4,194,577 | 5/1980 | Vann | 175/4.51 |
| 4,269,278 | 5/1981 | Vann | 175/4.51 |

*Primary Examiner*—Stephen J. Novosad
*Assistant Examiner*—Hoang C. Dang
*Attorney, Agent, or Firm*—Richard M. Byron; Patrick H. McCollum

[57] ABSTRACT

An elongated body member adapted for coupling to a well logging or perforating instrument in a fixed rotational relation, and formed such that at least a portion of the mass is eccentrically disposed relative to the longitudinal axis of the body member. Located within the eccentric mass of the body member is a recess for retaining one or more magnets. When the orienting decentralizer is introduced into a borehole, virtually any deviation of the borehole from true vertical will cause the longitudinal axis of the body member to tilt and the eccentric mass will cause the decentralizer to rotate about its longitudinal axis and seek equilibrium with the eccentric mass uniformly disposed beneath the tilted axis of the body member, thus rotating the attached logging or perforating instrument to a predictable orientation relative to the lower side of the borehole. In this orientation, within a cased borehole, the magnets will exert an attractive force upon the well casing to resist any departure from this predictable orientation.

6 Claims, 8 Drawing Figures

APPARATUS FOR DECENTRALIZING AND ORIENTING A WELL LOGGING OR PERFORATING INSTRUMENT

BACKGROUND OF THE INVENTION

This invention relates generally to improved well logging and perforating apparatus, and, more specifically relates to apparatus for decentralizing and orienting a well logging or perforating instrument relative to one side of a borehole.

In virtually any earth borehole, even those intended to be perfectly vertical and drilled accordingly, there will be at least a slight deviation from true vertical, yielding a high and low side to the borehole across a plane perpendicular to the borehole at any given depth. In deviated or inclined boreholes, this deviation from vertical is, by definition, more pronounced, thereby more clearly allowing the borehole to evidence high and low, or top and bottom, sides. In many well operations, particularly perforating operations, it is often desirable to locate the instrument against the borehole casing and to orient the instrument relative to the casing such that a certain side of the instrument will run along this bottom side of the borehole. This orientation relative to and against the casing is particularly useful in perforating operations.

In perforating operations a gun containing explosive charges is lowered into the borehole to a predetermined depth where the charges are fired, causing them to penetrate the borehole casing and the surrounding earth formations. One advantage of orienting the perforating gun relative to the borehole is that when these charges are fired with the perforating gun positioned such that the side from which the charges will emerge is located against the casing, the charges will penetrate the casing with a clean entrance hole rather than leaving a burred rim on the interior of the casing around the hole. Further the locating of the perforating gun against the borehole sidewall reduces the radial movement of the gun within the borehole in reaction to the explosive detonations, thereby reducing the likelihood of damage to the perforating gun. This post-detonation movement is further reduced when a means is provided for maintaining the positioning of the gun against the borehole sidewall.

The oil and gas industry has predominantly utilized devices of two classes for attempting to achieve the above-described orientation and decentralization. The first class is composed generally of devices consisting of a bow-spring affixed to and extending from one side of the logging or perforating instrument such that the spring exerts a force on the borehole sidewall, forcing the instrument against the opposite sidewall. The weight of the instrument is relied upon to orient the instrument to the bottom side of the borehole. Experience has shown these bow-spring devices are unweildy to handle, and may present difficulties when traversing wellheads or lubricators affixed to the top of the well. Additionally, these bow-spring orienting decentralizers show a tendency to bind in the borehole when attempting to traverse bends or reductions of diameter in the borehole.

The second class of orienting decentralizers consists generally of devices of an essentially cylindrical form with magnets mounted along one side. These devices orient solely by means of the magnets exerting an attractive force upon the well casing, therefore they have virtually no orienting capability in an uncased borehole. Further, with this class of orienting decentralizers, if the orienting decentralizer and attached instrument lie in an orientation such that the casing is not sufficiently acted upon by the magnets, the instrument, although resting on the lower side of the casing, will not be directed to the desired rotational orientation relative to that lower side of the casing. Further, the more closely the radius of the casing approaches the radius of the decentralizer, the lower the potential for the magnets, if they do contact the casing, to orient to the direct bottom or lower side of the casing and to similarly orient the attached instrument.

Accordingly, the present invention overcomes the deficiencies of the prior art by providing an apparatus which reliably orients a logging or perforating instrument relative to the bottom of a borehole and maintains such instrument in a predetermined rotational relation to such borehole.

SUMMARY OF THE INVENTION

The present invention provides a method and an apparatus for decentralizing and orienting logging and perforating instruments, in earth boreholes. The apparatus includes an elongated body member which has a portion of its length formed such that the mass of the body member is eccentrically disposed relative to the longitudinal axis of the body member. This eccentric mass imparts to the decentralizer a center of mass which is offset from the longitudinal axis of the decentralizer. This offset of mass creates a potential for the body member to seek equilibrium by rotating around its longitudinal axis whenever the longitudinal axis is tilted from vertical. The body member includes a longitudinal recess generally tangential to a line on the periphery of the body member and centered on the tangential radius directly beneath the longitudinal axis and the center of mass of the body member as the body member rests in equilibrium. Retained within this recess are one or more magnets. Also included on the body member is a means for cooperatively engaging the body member with the instrument to be oriented and a means for placing and securing the body member such that the magnets described above are in alignment with the side of the instrument which is desired to rest along the bottom side of the borehole.

When the orienting decentralizer and subsurface instrument are aligned and secured relative to one another the assembly is ready to be introduced into the well. The natural incline of the borehole, even in a so called vertical borehole, will cause the orienting decentralizer and instrument combination to tilt from vertical along the longitudinal axis, causing the decentralizer to rotate as described above and to orient the instrument relative to the borehole in the position established by the alignment made at the surface. As the decentralizer mass achieves equilibrium, the magnets are brought proximate the bottom side of the borehole. Where the borehole contains casing, the magnets will act thereon, further maintaining the orienting decentralizer and instrument aligned therewith in the desired orientation.

Accordingly, it is a feature of the present invention to provide a new and improved method and apparatus for decentralizing a well logging or a perforating instrument against one side of a borehole.

It is another feature of the present invention to provide a new and improved method and apparatus for decentralizing a well logging or a perforating instrument against the bottom side of a borehole and orienting such instrument to a predetermined rotational position therein.

It is yet another feature of the present invention to provide a new and improved method and apparatus for decentralizing a well logging or a perforating instrument against the bottom side of a cased borehole and orienting such instrument to a predetermined rotational position relative to said borehole.

DESCRIPTION OF THE PREFERRED EMBODIMENTS

Figure 1:
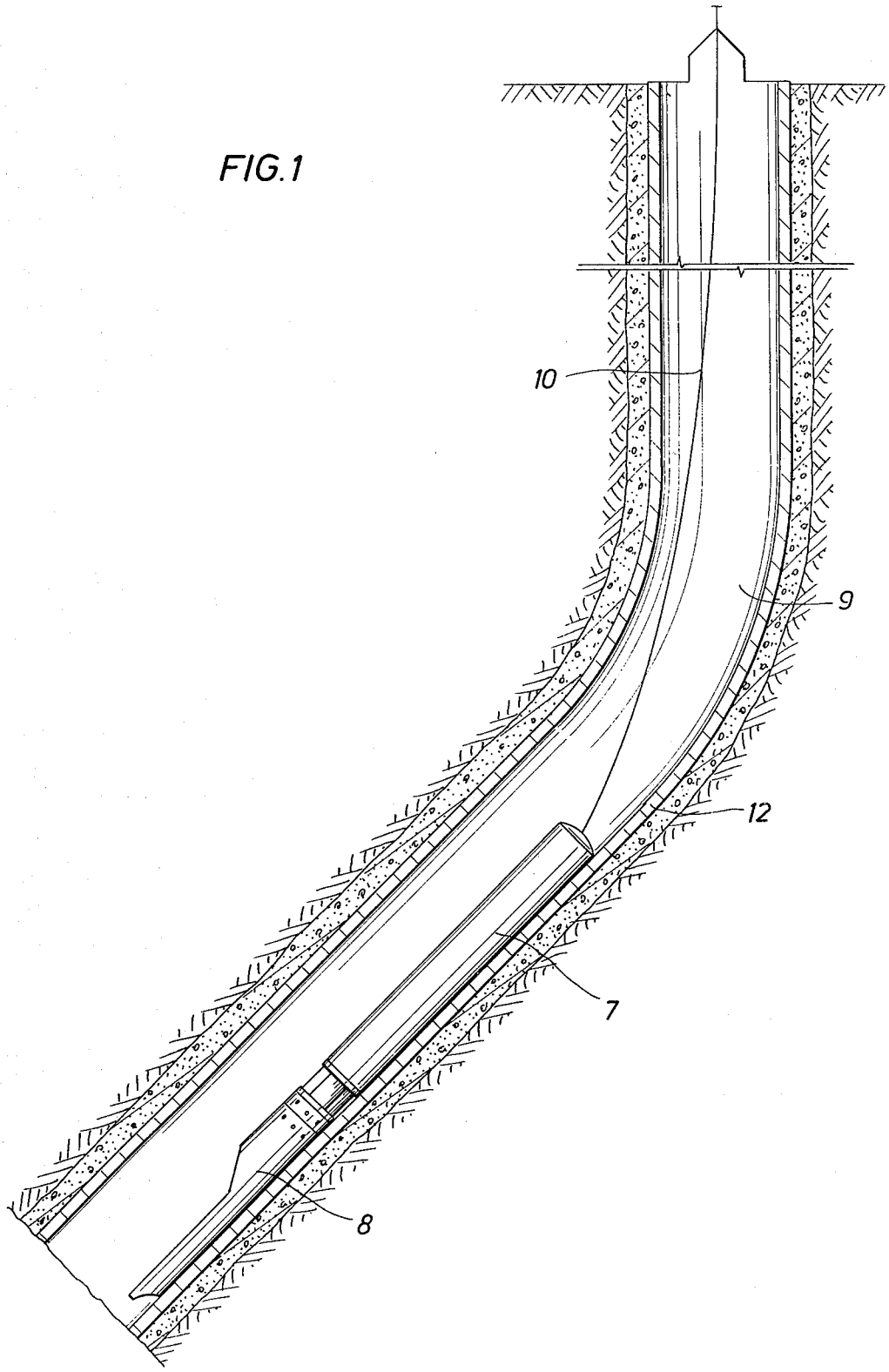
FIG. 1 is a pictorial view, partly in cross-section, showing the orienting decentralizer coupled to a subsurface instrument located in a deviated borehole.

Referring now to the drawings in more detail, particularly to FIG. 1, therein is illustrated one embodiment of a orienting decentralizer 8 in accordance with the present invention. The orienting decentralizer 8 is shown non-rotatably attached to the bottom of a logging or perforating instrument 7. The instrument 7 and the decentralizer 8 are suspended from a cable 10 and disposed within an earth borehole 9 in which casing 12 has been set, shown in cross-section. In such operation, when the combination is located within a deviated borehole, the decentralizer 8 seeks and maintains a specific rotational orientation relative to the bottom side of the well casing 12, thereby causing the attached instrument 7 to rest in a predetermined orientation relative to the bottom side of the well casing 12.

Figure 2A:
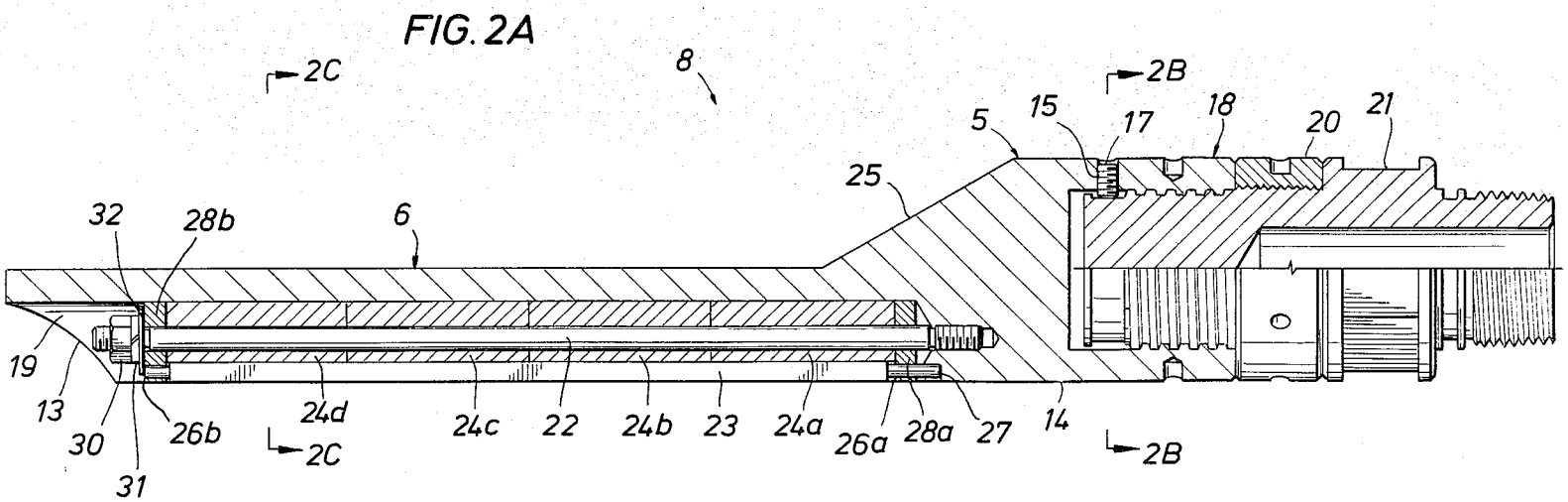
FIG. 2A represents, in longitudinal section, an embodiment of the orienting decentralizer apparatus.
Figure 2B:
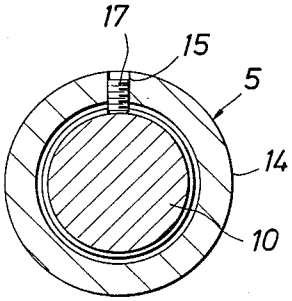
FIG. 2B represents a cross-sectional view of the orienting decentralizer apparatus taken along the lines B—B of FIG. 2A.
Figure 2C:
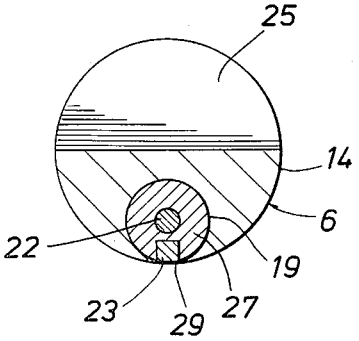
FIG. 2C represents a cross-sectional view of the orienting decentralizer apparatus taken along the lines C—C of FIG. 2A.

Referring now to FIGS. 2 A–C of the drawings, therein is illustrated in greater detail and partly in cross-section, the orienting decentralizer 8 of FIG. 1. The decentralizer 8 is constructed upon an elongated body member 14, constructed of a suitably dense material, preferably a non-magnetic metal, most preferably non-magnetic steel. Viewed in longitudinal section, the body member 14 has a first end portion 5 of a generally circular shape, illustrated in FIG. 2B, and an elongated portion 6 of a generallly semicircular configuration, as illustrated in FIG. 2C. The second end of body member 14 is of a generally semicircular cross-section, having a gradual, concave taper 13 about the curvilinear pheriphery of the semicircular cross-section extending to points proximate the longitudinal axis of body member 14.

The first or generally circular end 5 of body member 14, houses the orienting coupling sub assembly, indicated generally at 18, by which the decentralizer 8 is attached to the logging or perforating instrument 7. Coupling sub assembly 18 is composed of coupling sub 21 and locking collar 20. Locking collar 20 is joined to coupling sub 21 by suitable means, preferably threadable means, and this assembly is suitably joined to body member 14, again preferably by threadable means, preferably within the end of body member 14. Body member 14 has a threaded aperture 15, suitable for accepting a set screw 17, positioned such that set screw 17 is engagable with coupling sub 21.

The elongated, or essentially semicircular portion 6 of the orienting decentralizer 8 represents the configuration which imparts an eccentric mass to the orienting decentralizer 8. The generally semicircular configuration creates an uneven disposition of mass around the longitudinal axis of the orienting decentralizer 8. This eccentric disposition of mass creates a rotational potential in the orienting decentralizer for the eccentric mass to seek equilibrium by rotating around the longitudinal axis whenever the longitudinal axis deviates or tilts from vertical. Equilibrium is achieved when the center of mass of the decentralizer which, due to the above described eccentric mass does not coincide with the longitudinal axis of the decentralizer, is disposed directly beneath the tilted longitudinal axis of the orienting decentralizer. It is this rotational potential which causes the orienting decentralizer to initially attain the desired orientation with regard to the borehole. It can therefore be appreciated that to maximize this rotational potential it is desirable for the portion of body member 14 having a semicircular cross-section 6 to extend over a majority of the length of the body member 14. In the preferred embodiment, this hemispherical cross-section 6 extends for approximately two-thirds of the total length of body member 14. The transition from the first or generally circular end 5 of body member 14 to the portion of generally semicircular cross-sectional configuration 6 is accomplished by means of a gradual slope section 25 so as to minimize the bending moment in body member 14.

Located within body member 14 is a longitudinal recess 19, preferably of a generally cylindrical bore, centered on the curvilinear portion of the periphery of the semicircular cross-section and approximately tangential to the periphery of body member 14. The recess 19 extends from the second end of body member 14 for a suitable distance, preferably to a point beneath the sloping transition 25 between the two cross-sections described above. In the preferred embodiment, a longitudinal slot 29, of a width suitable to allow the introduction therein of shaft 23, is centered about the radial line extending from the longitudinal axis of body member 14 to the point at which recess 19 and the periphery of body member 14 most closely approach coincidence. The function of shaft 23 will be discussed more fully herein below.

Mounted within recess 19 are one or more magnets, preferably a plurality of magnets, most preferably four magnets. These magnets **24*a*, 24*b*, 24*c* and 24*d* are also preferably permanent magnets with a high flux density and are preferably of an elongated form with a generally horseshoe-shaped cross-section having an outer curvilinear form complimentary to and matable with the shape of recess 19. Magnets 24***a*, 24*b*, 24*c* and 24*d* are mounted within recess 19 with their cross-sectional end pieces extending generally toward the pheriphery of body member 14. These magnets 24*a*, 24*b*, 24*c* and 24*d* are retained within recess 19 by a retaining rod 22, preferably composed of non-magnetic steel, extending longitudinally through the magnets 24*a*, 24*b*, 24*c*, 24*d* and retaining them in mechanical serial alignment. Rod 22 is suitably joined, preferably by threadable means, to body member 14 at the interior end of the recess 19. Located proximate each end of rod 22 on each end of the plurality of magnets 24*a*, 24*b*, 24*c* and 24*d* and serially aligned therewith is a retainer 28*a* or 28*b*. A shaft 23 extends longitudinally in body member 14 parallel to rod 22 and serves to maintain magnets 24*a*, 24*b*, 24*c* and 24*d* oriented with the openings between their end pieces, and in turn their flux fields, aligned relative to the pheriphery of body member 14 (illustrated in FIG. 2C). Shaft 23 is constructed of a suitable non-magnetic material and is of a suitable size and shape so as to engage the openings between the magnet ends. The shaft 23 has a first end, preferably of a cylindrical configuration, formed to engage and pass through an aperture 26*a* in retainer 28*a* and to mate with a complimentary recess 27, preferably a cylindrical hole, in body member 14 on the interior edge of recess 19. The second end of shaft 23 is suitably formed, again preferably cylindrically, to mate with an aperture 26*b* in retainer 28*b*. The engagement of shaft 23 with recess 27 in body member 14 and with magnets 24*a*, 24*b*, 24*c*, 24*d* serves to maintain the orientation of the magnets 24*a*, 24*b*, 24*c*, 24*d* and retains the first end of shaft 23 within body member 14 while the mating of shaft 23 and retainer 28*b* serves to retain the second end of shaft 23 within body member 14. The magnets 24*a*, 24*b*, 24*c*, 24*d* and retainers 28*a*, 28*b* are secured in place along rod 22 by conventional means, preferably a nut 30, lock washer 31, and flat washer 32.

Referring now to FIGS. 1 and 2 A–C generally, in the intended operation of the orienting decentralizer, with the proximal end of the logging or perforating instrument attached to cable 10, coupling sub 21 is threadably joined to the distal end of the logging or perforating instrument 7. Decentralizer body 14 is then rotated around coupling sub 21 until shaft 23, the line centered between the ends of magnets 24*a*, 24*b*, 24*c*, 24*d*, is in mechanical alignment with the instrument surface which is desired to rest along the bottom side of the borehole. Set screw 17 is then tightened to maintain the relative rotative positions of the orienting decentralizer 8 and the instrument 7. Orienting collar 20 is then rotated and tightened against body member 14, acting essentially as a conventional locking nut to fixedly secure the rotational position previously fixed with set screw 17. The assembly is then ready for introduction into the well.

When the assembly is lowered into the well, as the borehole deviates from a vertical angle, thereby causing the longitudinal axis of the orienting decentralizer to shift from vertical, the eccentric mass of the decentralizer 8 will seek equilibrium as described above, causing the orienting decentralizer 8 and the attached instrument 7 to rotate such that the longitudinal line along shaft 23 in the orienting decentralizer 8 will rest along the bottom side of the borehole, thus placing instrument 7 in the desired orientation as established previously described alignment operation. In this orientation, if the borehole is cased, and if such casing is magnetically susceptible, as is typical in the oil and gas industry, magnets 24*a*, 24*b*, 24*c*, and 24*d* exert an attractive force upon the well casing to resist any departure from the aforementioned orientation by the orienting decentralizer 8 and instrument 7 combination.

Figure 3:
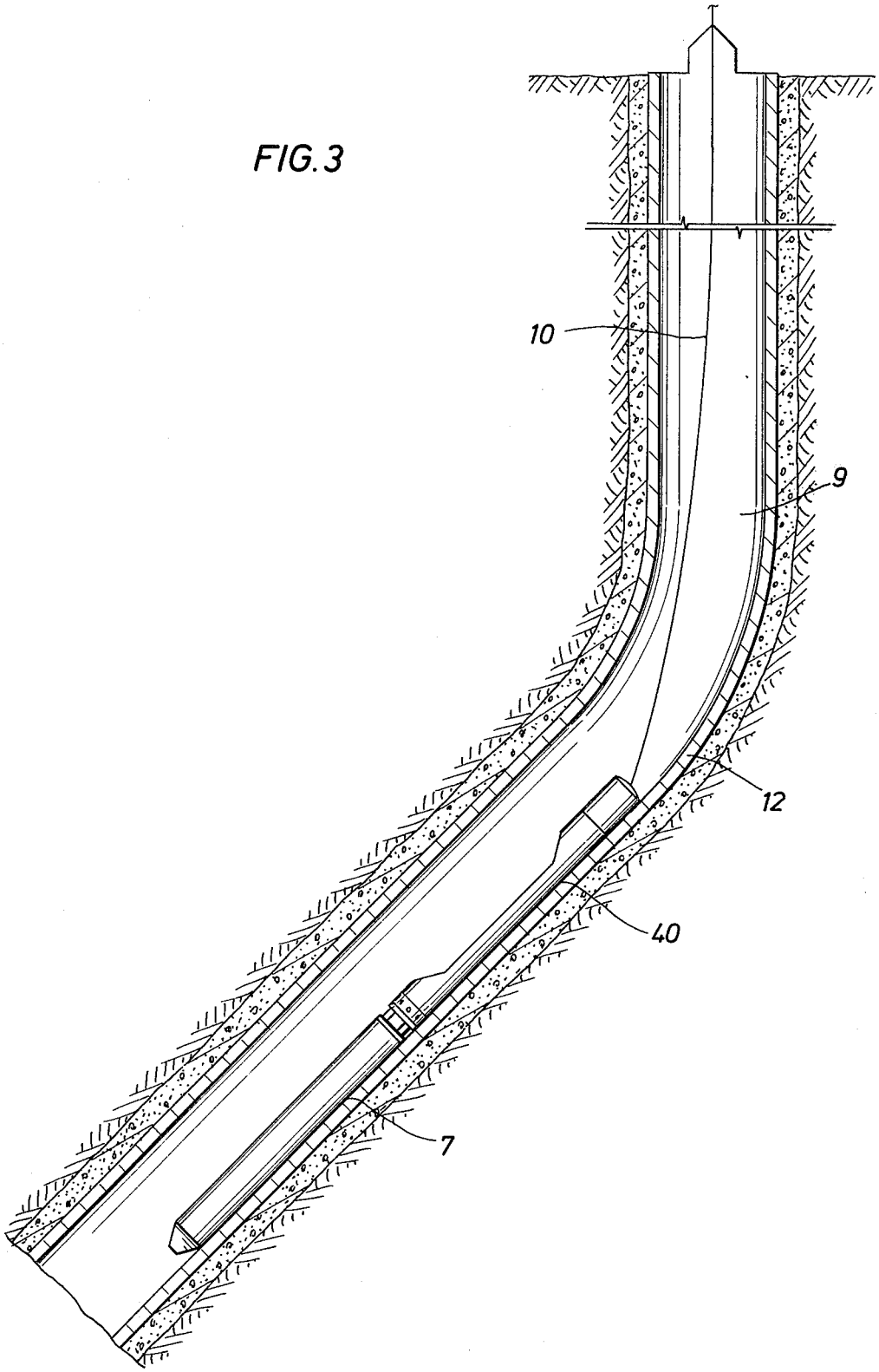
FIG. 3 is a pictorial view, partly in cross-section, showing an alternate embodiment of the orienting decentralizer coupled to a subsurface instrument located in a deviated borehole.
Figure 4A:
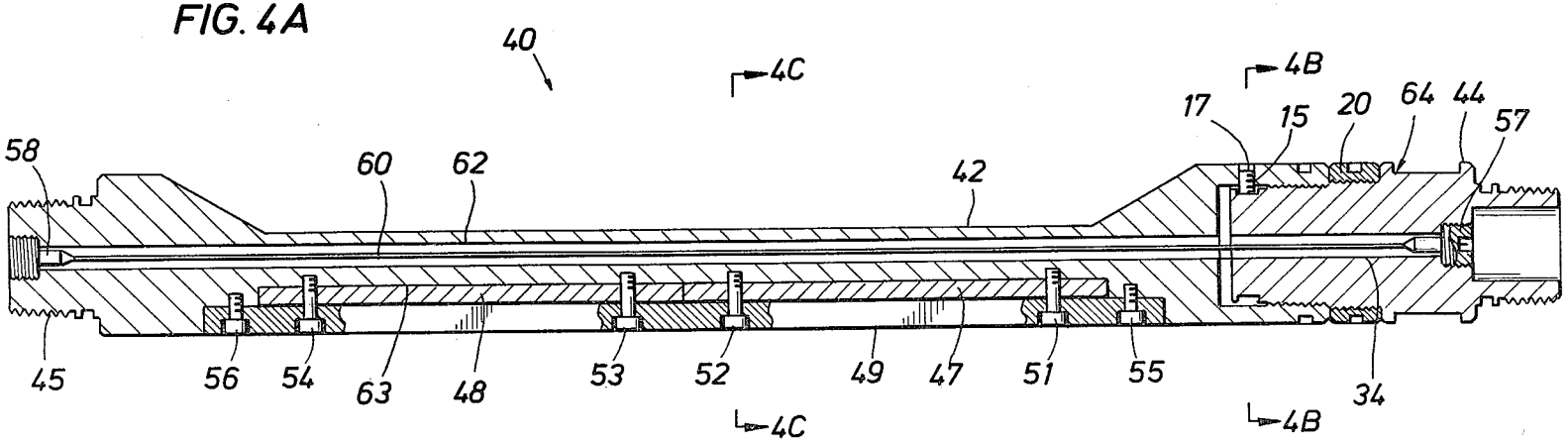
FIG. 4A represents, in longitudinal section, the alternate embodiment of the orienting decentralizer apparatus illustrated in FIG. 3.

Referring now to FIG. 3 of the drawings, therein is illustrated an alternative embodiment of a orienting decentralizer 40 in accordance with this invention. It will be noted that like elements in the illustrations of each of the embodiments have been numbered similarly. The decentralizer 40 is shown attached to the top of the instrument 7 rather than at the bottom as the previous embodiment was illustrated. While this alternative embodiment of the invention contains the same essential design features as the embodiment previously described, certain modifications have been made to accommodate this operating configuration. The modifications incorporated into this alternative embodiment, which are discussed herein below, include coupling subs 44 and 45 (illustrated in FIG. 4A) at each end of the decentralizer 40, a different means of mounting the magnet assembly, and provisions for conducting electrical signals between cable 10 and instrument 7.

Figure 4B:
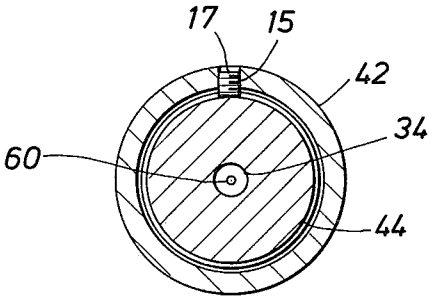
FIG. 4B represents a cross-sectional view of the orienting decentralizer apparatus taken along the lines B—B of FIG. 4A.
Figure 4C:
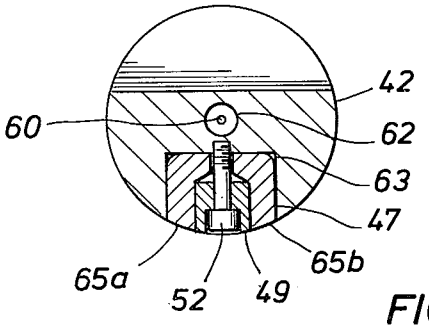
FIG. 4C represents a cross-sectional view of the orienting decentralizer apparatus taken along the lines C—C of FIG. 4A.

Referring now to FIGS. 4 A–C of the drawings, the two coupling subs 44, 45 and other modifications from the previously described embodiment can be seen more clearly. The orienting coupling sub assembly, indicated generally at 64, is essentially identical to that previously described in the discussion of the original embodiment with the exception of the addition of an electrical connector 57, inserted proximate the end of coupling sub 44, suitable for making electrical contact with an electrical connector within the logging or perforating instrument 7 and an aperture 34 extending longitudinally from connector 57 through the coupling sub 44. The end of body member 42 opposite that containing the orienting coupling sub assembly 64 is of a configuration forming a coupling sub 45 suitable for mating with a logging cable (legend 10 in FIG. 3). Included in this coupling sub 45 is an electrical connector 58 suitable for making electrical contact with the electrical conductor within the logging cable and having physical access to a longitudinal aperture 62 in body member 42. The aperture 34 in coupling sub 44 and the aperture 62 in body member 42 serve together to form a passage suitable for containing one or more electrical conductors 60 joining electrical connectors 57 and 58. In the preferred embodiment these apertures 34, 62 are located along the longitudinal axis of the decentralizer 40. It can therefore be appreciated that the portion of the body member 42 which forms the eccentric mass of the decentralizer 40, when viewed in lateral cross-section, encompasses a greater than semicircular cross-section of body member 42 so as to surround and define passage 62 (illustrated in FIG. 4C).

This embodiment of the invention contains one or more magnets, most preferably two magnets 47, 48 of a generally oblong shape and preferably having a generally squared horseshoe-shaped cross-section. These magnets lie within a recess 63 centered along the curvilinear portion of the eccentric mass of body member 42. The ends 65*a*, 65*b* of the magnets, 47, 48 as they are viewed in lateral cross-section, are of such curved dimension so as to continue to define the radius of body member 42 when the magnets 47, 48 are cooperatively arranged in recess 63. Magnets 47, 48 are retained in body member 42 by retaining bar 49 which is of a suitable non-magnetic material such as non-magnetic steel and of a suitable length to extend beyond the longitudinal dimension of recess 63 and of a suitable width to mate with the gap between the cross-sectional ends 65*a*, 65*b* of the magnets 47, 48. Retaining bar 49 is also mounted within a suitable recess in body member 42 such that the bar 49 does not extend beyond the radius of body member 42. Retaining bar 49, and in turn the magnets 47, 48 are secured to body member 42 by conventional means, preferably a plurality of bolts 51, 52, 53, 54, 55, 56 which are counter-sunk within bar 49 and threadably mated to body member 42.

In the operation of this alternative embodiment of the orienting decentralizer invention, coupling sub 44 is coupled to the logging or perforating instrument 7 and oriented therewith in the manner described for the previous embodiment. Coupling sub 45 is then suitably joined to cable 10 and the assembly is ready to be introduced into the borehole 9. It will be appreciated that electrical signals may be transmitted between the instrument 7 and the cable 10 by means of the electrical connectors 57, 58, located in coupling subs 44 and 45 respectively, and electrically coupled together by conductor 60. The orienting operation of the orienting decentralizer 40 is essentially identical to that previously described for the original embodiment of the invention.

Many modifications and variations besides those specifications mentioned may be made in the techniques and structures discussed herein and in the accompanying drawings without departing substantially from the concept of the present invention. For example, heavy metal such as tungsten or depleted uranium could be used in the body member to increase the orienting potential of the decentralizer, or electro-magnets could be utilized in place of the permanent types herein described to maintain the orientation to the well casing. Additionally, it is obvious that this method of orienting a logging or perforating instrument could be incorporated as an integral part of such an instrument. Accordingly, it should be clearly understood that the forms of the invention described and illustrated are exemplary only and are not intended as limitations on the scope of the present invention.

The embodiments of the invention in which an exclusive property or privilege is claimed are defined as follows:

1. An apparatus for orienting a logging or perforating instrument supported by a cable and disposed within a cased borehole to the lower side of said borehole, comprising;

an elongated body member having a first end portion of generally circular lateral cross-section adapted to attach to said instrument;

said body member having an elongated portion wherein the mass of said body member exhibits a generally truncated circular lateral cross-section, said truncated circular lateral cross-section being predominantly disposed to one side of the longitudinal axis of said body member;

said body member having one or more longitudinal recesses within said elongated portion said longitudinal recesses generally centered upon the curvilinear portion of said truncated circular lateral cross-section of said body member; and one or more permanent magnets cooperatively arranged within said recesses.

2. The apparatus for orienting a logging or perforating instrument of claim 1, wherein said body member further comprises a second end of a generally circular lateral cross-section, said second end adapted to attach to said cable.

3. The apparatus for orienting a logging or perforating instrument of claim 1, wherein said body member is constructed of a non-magnetic material.

4. An apparatus for orientating a logging or perforating instrument within a cased borehole with respect to the bottom side of the borehole, comprising:

an elongated body member having an eccentric distribution of mass about the longitudinal axis of said body member, said body member rotatably coupled to said instrument;

said eccentric distribution of mass comprising an elongated portion of said body member having a truncated circular lateral cross section with a longitudinal recess within said eccentric mass, said recess generally centered upon the curvilinear portion of said truncated circular lateral cross section;

one or more elongated magnets disposed within said longitudinal recess in said eccentric mass of said body member; and means for selectively indexing and securing said body member in a preselected one of a plurality of fixed rotational relations relative to said instrument.

5. The apparatus for orienting a logging or perforating instrument of claim 4, wherein said body member is constructed of a non-magnetic metal.

6. The apparatus for orienting a logging or perforating instrument of claim 5 wherein said means for selectively indexing and securing said body member, comprises:

a coupling sub-mechanically connected to said instrument and rotatably connected to said elongated body member;

a set screw for selectively securing said elongated body member in a preselected one of a plurality of fixed rotational positions; and a locking collar for locking said elongated body member in said fixed rotational position.

* * * * *